US005639253A

United States Patent [19]

Rantanen

[11] Patent Number: 5,639,253

[45] Date of Patent: Jun. 17, 1997

[54] EXTENSION PLUG-IN UNIT

[75] Inventor: Kari Rantanen, Klaukkala, Finland

[73] Assignee: Oy Euro Equipment Ltd., Klaukkala, Finland

[21] Appl. No.: 722,525

[22] Filed: Sep. 27, 1996

Related U.S. Application Data

[63] Continuation of Ser. No. 343,485, filed as PCT/FI94/00114, Mar. 28, 1994, abandoned.

[30] Foreign Application Priority Data

Mar. 29, 1993 [FI] Finland ..... 931403
May 13, 1993 [FI] Finland ..... 932181

[51] Int. Cl.[6] ..... H01R 4/50

[52] U.S. Cl. ..... 439/341; 439/376

[58] Field of Search ..... 439/341, 376, 439/378, 372, 924.1

[56] References Cited

U.S. PATENT DOCUMENTS 3,617,985 11/1971 Kehl ..... 439/341
3,984,169 10/1976 Armstrong et al. ..... 439/341
4,082,400 4/1978 Gansert ..... 439/341
4,104,588 8/1978 Westberry ..... 439/378
4,941,840 7/1990 Okada ..... 439/376
5,104,331 4/1992 Goble ..... 439/376

FOREIGN PATENT DOCUMENTS 3634695 4/1988 Germany ..... 439/341

*Primary Examiner*—Hien Vu
*Attorney, Agent, or Firm*—Ladas & Parry

[57] ABSTRACT

The invention relates to an extension plug-in unit comprising a socket (2) connected to a first cable (1) and a plug (4) connected to a second cable (3), said plug (4) and socket (2) having cooperating contact means (5, 6) comprising male and female contacts for electrical connection of the first cable (1) to the second cable (3) and cooperating connecting means (7, 8, 9) for joining the plug (4) mechanically to the socket (2). To enable a mechanically simple and reliable construction, the male and female contacts (5, 6) are disposed to be located substantially in succession in the axial direction of the cables (1, 3), and the mechanical contact means comprise hinge means (7, 8) at one end of the plug and the socket for articulated joining of the plug and socket and locking means (9) at the other end of the plug and the socket for locking the plug (4) and socket (2) together at said ends when they are pressed against one another.

3 Claims, 1 Drawing Sheet

EXTENSION PLUG-IN UNIT

This application is a continuation of application Ser. No. 08/343,485 filed on Jan. 20, 1995, abandoned, which is International Application PCT/FI94/00114 filed on Mar. 28, 1994 and which designated the U.S.

FIELD OF INVENTION

The present invention relates to an extension plug-in unit comprising a socket connected to a first cable and a plug connected to a second cable, said plug and socket having cooperating contact means comprising male and female contacts for electrical connection of the first cable to the second cable and cooperating connecting means for joining the plug mechanically to the socket when their contact means are in contact with one another.

BACKGROUND OF INVENTION

In a conventional extension plug-in unit, which consists of a socket attached to a first cable and a plug attached to a second cable, both the socket and the plug have a generally cylindrical shape. This cylindrical shape presents several problems. First, the contacts of the plug and the socket must be located within a circular area normally in parallel with their attached cables. Since it is not desired to make the diameter of the cylinder inordinately large, in extension plug-in units for relatively high currents, e.g. about 100 A, the connections between the cables and the connectors of the plug and the socket must be executed in succession in the axial direction. This considerably increases the length of both the plug and the socket, making them awkward and heavy to handle. On the other hand, the cylindrical shape necessitates a considerable force for inserting the plug into the socket, on account of the size of the friction surface therebetween. Further, these surfaces will be quickly soiled and become dirty, which adds to the force required. Also locking the parts of the extension plug-in unit together is relatively difficult with such cylindrical sockets and plugs. Often sleeve-like parts applying threaded couplings or the like must be used to perform the locking; the parts are adapted to slide and turn about the cylindrical body of the plug and socket but are not slidable in the axial direction beyond their free ends. Also, such axially elongated extension plug-in units cannot be accommodated in a small space and can utilize only very reduced bending radiuses. A further problem with such axially connectable sockets and plugs is that reliable coupling of the contacts in a specific order is relatively difficult to achieve without further increasing the length of the socket and the plug. Neither are the conventional extension plug-in unit plugs or sockets suitable for branching a cable but can only be employed for cable extension.

SUMMARY OF INVENTION

It is an object of the present invention to provide a novel extension plug-in unit unattended by the above disadvantages. This is achieved with an extension plug-in unit of the invention, which is characterized in that the male and female contacts are disposed to be located substantially in succession in the axial direction of the cables, and that the mechanical contact means comprise hinge means at one end of the plug and the socket for articulated joining of the plug and socket and locking means at the other end of the plug and the socket for locking the plug and socket together at said ends when they are pressed against one another.

Since in the extension plug-in unit of the invention the male and female contacts are disposed to be located substantially in succession in the axial direction of the cables in either one or several rows or possibly to form a zigzag pattern, connections to the different connectors of the cable can be executed at the location of the actual contacts, and thus the length of both the plug and the socket in the axial direction is considerably diminished in comparison with the prior art. On the other hand, an articulated connection enables the contacts to be reliably connected in a specific order, the contact closest to the joint being the first to be connected, etc. Since, moreover, the connection is based on turning relative to the point of articulation and not on axial insertion as in the earlier constructions, the coupling forces required are also considerably smaller. Furthermore, after the actual connection the joint coupling can be locked simply by connecting the ends of the plug and socket opposite the coupling to one another for example by means of a mechanical lever or latch.

In a preferred embodiment of the invention, the male contacts comprise substantially rectangular contact pins extending from the plug substantially perpendicularly to the axial direction of the attached cable and the female contacts comprise contact lamellae located in the socket and spring-biased in pairs against one another, each contact pin being adapted to push between the lamellae of one pair of lamellae. The articulated execution of the extension plug-in unit of the invention allows the use of substantially rectangular contact plugs, and thus the female contacts for them can be formed of two contact lamellae biased for example by a spring against one another, and thus the pressing force required is small and yet the connection is reliable.

BRIEF DESCRIPTION OF THE DRAWINGS

In the following the extension plug-in unit of the invention will be described in more detail with reference to the accompanying drawing, in which.

DETAILED DESCRIPTION OF PREFERRED EMBODIMENT

Figure 1:
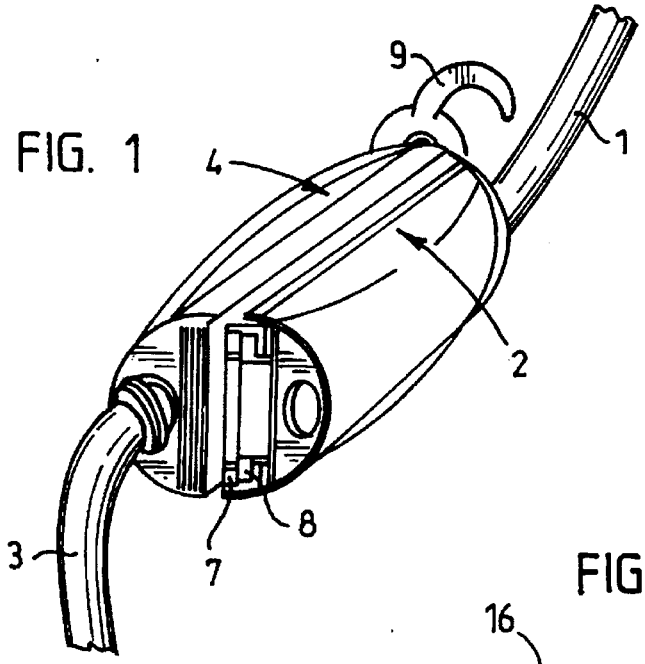
FIG. 1 shows an entire extension plug-in unit according to the invention.

The extension plug-in unit of the invention shown in FIG. 1 comprises a socket 2 and a plug 4. Cable 1 is attached to socket 2, and cable 3 is attached to plug 4. The socket 2 and plug 4 are connected together at their one end by means of a joint assembly formed by parts 7 and 8. At their other ends the socket 2 and plug 4 are locked for instance with a latch 9 of the kind shown in FIG. 1, which is articulated to plug 4 and may be retained by a cable clamp 15 provided at the juncture of the socket 2 and cable 1 and shown in more detail in FIGS. 2 and 3.

Figure 2:
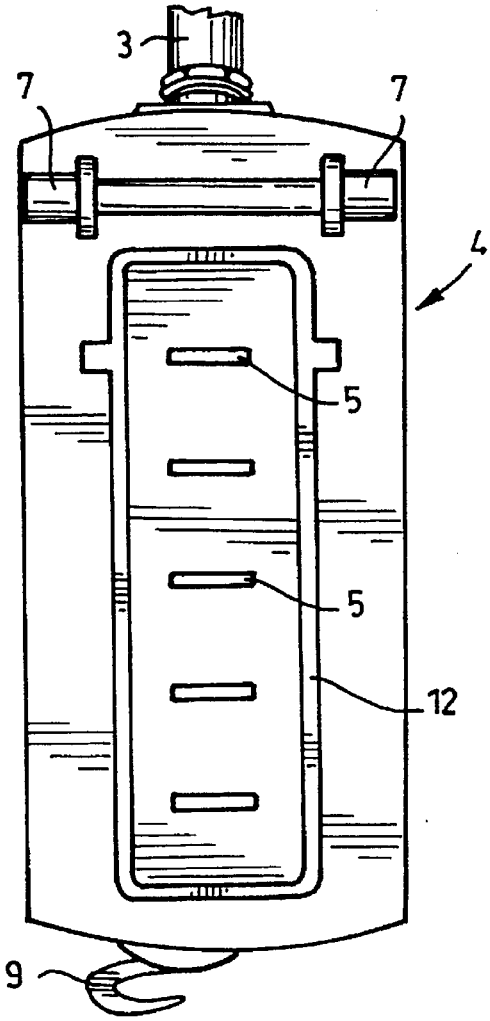
FIG. 2 shows a plug included in the extension plug-in unit of FIG. 1.
Figure 3:
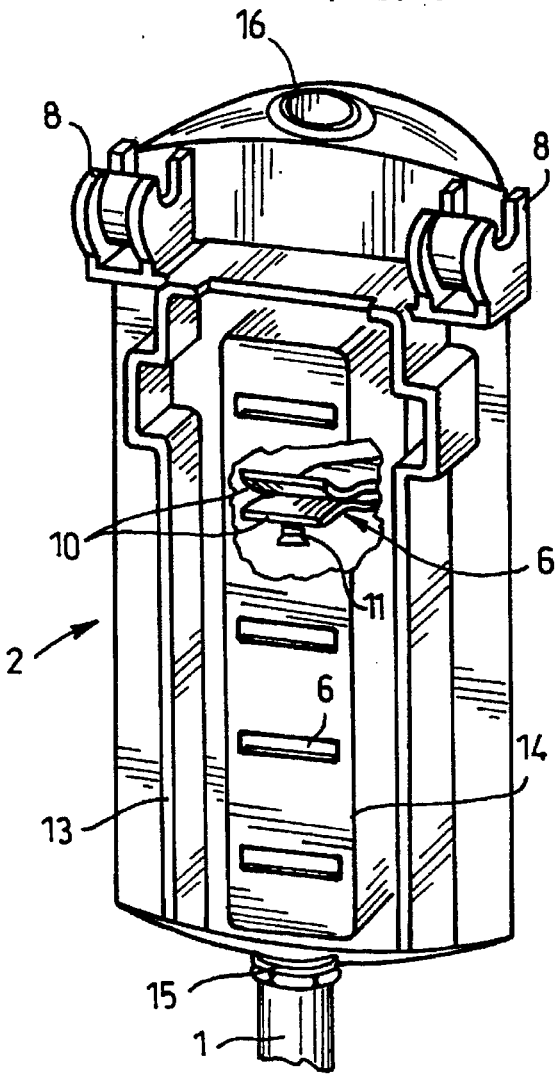
FIG. 3 shows a socket included in the extension plug-in unit of FIG. 1 in a partially exploded view.

As is shown in closer detail in FIGS. 2 and 3, the male contacts 5 and respectively the female contacts 6 in the plug 4 and socket 2 of the invention are located substantially in succession in the axial direction of the cables 1 and 3. Thus connecting the conductors of cables 1 and 3 to their contacts can take place substantially at the location of each contact. It is further shown in FIGS. 2 and 3 that the contacts 5 and 6 extend from the socket and plug substantially perpendicularly to the axial direction of the cables 1 and 3 attached to the socket and plug. In the embodiment shown in FIGS. 2 and 3, the number of contacts is five, which is a common number in view of a three-phase cable including a neutral conductor and an earthing conductor. Naturally the number of contacts may vary according to need. The contacts can also be disposed in two or possibly more rows or for example in a zigzag pattern without departing from the basic idea of the invention. Naturally such modifications make the extension plug-in unit larger in size, but on the other hand more contacts can be accommodated in the unit in this way, in case this should prove necessary.

FIG. 2 shows in more detail a plug 4 included in the extension plug-in unit of the invention. Seen from the direction of contact pins 5, this plug 4 comprises a generally rectangular body having a rounded rear face as shown in FIG. 1, and thus in accordance with FIG. 1 the overall shape of the actual extension plug-in unit is substantially cylindrical. As shown in FIG. 2, pivot journals 7 extending from the body are provided at the cable end of the plug 4. The plug further comprises a generally rectangular frame 12 protruding from the body 4 in the direction of the contact pins 5 and being adapted to surround the contact pins 5. The projection of this frame 12 from the body 4 substantially corresponds to the length of the contact pins 5. As can be seen from FIG. 2, the contact pins 5 are of a rectangular cross-section such that their short side is substantially in parallel with the axial direction of the housing 4 and the attached cable 3. A latch means, such as a hook 9, is provided at the end of the plug 4 opposite the pivot journals 7, for locking the plug with the socket. This hook is articulated at its one end to the plug 4 such that it can simply be turned about the cable clamp 15 of the socket pressed against the plug.

FIG. 3 shows a socket included in the extension plug-in unit of the invention in a partially exploded view. Seen in the direction of the female contacts 6, this socket 2 comprises a generally rectangular housing the rear face of which is rounded similarly as that of plug 4. Grooved shoulders 8 are provided at one end of the body of the socket 2, providing a counterpart for the pivot journals 7 of the plug 4, so that the pivot journals and shoulders 8 provide a hinge-type joint when fitted against one another. The socket further comprises a generally rectangular frame 13 protruding from its surface. The frame is so dimensioned that it is seated about the frame 12 of the plug when the plug is inserted into the socket. The socket further comprises a generally rectangular inner platform 14 adapted to surround the female contacts 6 and being seated within the frame 12 of the plug when the plug is inserted into the socket. The height of the platform 14 thus essentially corresponds to the length of the contact pins 5. A seal for the relative sealing of the plug and socket can preferably be laid on the bottom of the space between the frame 13 and inner platform 14, and thus the frame 12 of the plug will be pressed against the seal when the plug is pushed against the socket. Female contacts 6 are provided within the platform 14 of the socket 2. These contacts comprise two contact lamellae 10 biased against one another by means of a spring 11 and being bent slightly apart at their outer ends. Thus the contact pins 5 are easily directed between the contact lamellae 10 when the plug is inserted into the socket.

As will be seen from FIGS. 1–3, connection of the extension plug-in unit of the invention is executed in such a way that the pivot journals 7 of the plug 4 are fitted to the shoulders 8 of the socket 2 to make a hinged joint, and thereafter the other ends of the plug and socket are pressed against one another, thus connecting the contact pins 5 one at a time with their corresponding female contacts 6. The first contact to connect is naturally the one closest to the joint formed by the pivot journals 7 and shoulders 8. Once the plug is thus inserted into the socket in a jointed manner, also the other ends of the plug and socket are connected to one another by means of the locking hook 9 provided in the plug 4, by turning it about the cable clamp 15 of cable 1.

As is shown in FIG. 3 as well as in FIG. 1, a cable through-connection point 16 is also provided at the end of the socket 2 opposite the cable 1. Thus the cable 1 can also extend further from the other end of socket 2. The cable 1 would thus extend through the socket 2, and the plug 4 would only provide branching for this cable 1. Such a possibility for branching is not provided in conventional extension plug-in units.

The extension plug-in unit of the invention is suitable for use with a wide variety of cable sizes. Thus its current rating may be for example 16 A–125 A. All these cable sizes can be connected to a fully similar extension plug-in unit according to the invention without any need to change its dimensions. For this purpose, the socket and plug naturally employ universal connectors to which conductors of various sizes can be connected. For such a single dimensioning of plug and socket not to present any hazards or problems, the plugs and sockets in accordance with the invention should be furnished with appropriate fuses according to the size of the attached cable.

In the above, the extension plug-in unit of the invention has been set forth only by means of one exemplary embodiment, and it is to be understood that many modifications can be made to its mechanical properties without departing from the scope defined in the appended claims. The essential feature of the extension plug-in unit of the invention is that its components are articulatedly joined and that the contacts are located in succession in the opening direction of the joint, as is called for by the articulated mode of operation. The contacts need not, however, be in succession but may in fact be partly parallel, even though such solutions would complicate the execution of the electrical connections to some extent, and possibly make the extension plug-in unit larger in size.

I claim:

1. An electrical extension plug-in unit, comprising:

first and second electrical elongated extension members each having opposite-side ends;

cable attachment means at one of the opposite-side ends of each of the first and second electrical extension members respectively for receiving first and second electrical cables;

cooperating hinge means at one of the ends of each of the first and second electrical extension members for releasably and hingedly connecting the first and second electrical extension members in open and closed position respectively;

locking means at an opposite one of the ends of at least one of the first and second electrical extension members from the cooperating hinge means for locking the first and second electrical extension members together in the closed position thereof;

male contacts in the first electrical extension member and female contacts in the second electrical extension member respectively for electrical connection to the first and second electrical cables and, in the closed position of the first and second electrical extension members, for electrical connection to each other, whereby to electrically connect the first and second electrical cables; and cable through-connection means having a hole at an opposite one of the ends of one of the first and second electrical extension members from the one of the ends thereof with the cable attachment means for the respective one of the first and second electrical cables to extend effectively through the one of the first and second electrical extension members.

2. An electrical extension plug-in unit as claimed in claim 1, wherein the male contacts comprise substantially rectangular contact pins and the female contacts comprise pairs of contact lamellae disposed in the socket, the pairs being spring-biased against one another, each contact pin being adapted to push between the lamellae of one of the pairs.

3. An electrical plug-in unit as claimed in claim 2, wherein the rectangular contact pins of the plug have a cross-section having a short side and a long side.

* * * * *